United States Patent [19]

Dingler

[11] 4,221,097

[45] Sep. 9, 1980

[54] STEEL SECTIONS FOR FRAMEWORK PANELS

[76] Inventor: Gerhard Dingler, Ortsstrasse 1, 7274 Haiterbach, Fed. Rep. of Germany

[21] Appl. No.: 963,798

[22] Filed: Nov. 27, 1978

[51] Int. Cl.[2] ..... E04C 3/30

[52] U.S. Cl. ..... 52/731; 52/781

[58] Field of Search ..... 52/731, 777, 781; 249/4, 5, 6, 33, 38, 44

[56] References Cited

U.S. PATENT DOCUMENTS

| | | | |
|---|---|---|---|
| 3,611,666 | 10/1971 | Poyser et al. | 52/731 |
| 3,731,902 | 5/1973 | Shoemaker | 249/33 X |
| 3,735,547 | 5/1973 | Moyer et al. | 52/731 |

FOREIGN PATENT DOCUMENTS

| | | | |
|---|---|---|---|
| 565292 | 8/1975 | Switzerland | 52/731 |

*Primary Examiner*—James A. Leppink
*Assistant Examiner*—Carl D. Friedman

[57] ABSTRACT

A steel section has a protuberance which rests on the outer circumferential surface of a framework panel concrete. A first short flange rests on the inner side of the panel. A second, long flange extends perpendicular to the framework panel and has a shallow V-shaped indentation. A third, short, flange lies parallel to the framework panel and a fourth flange continues to the protuberance. The third flange consists of two part-flanges butt-welded and flush-machined on the outer surface. The protuberance has three walls. The second, short, wall is parallel to the framework panel. The third wall is bent back to the first wall at an acute angle. The corner angle between the first flange and the third wall is less than 90 degrees.

5 Claims, 1 Drawing Figure

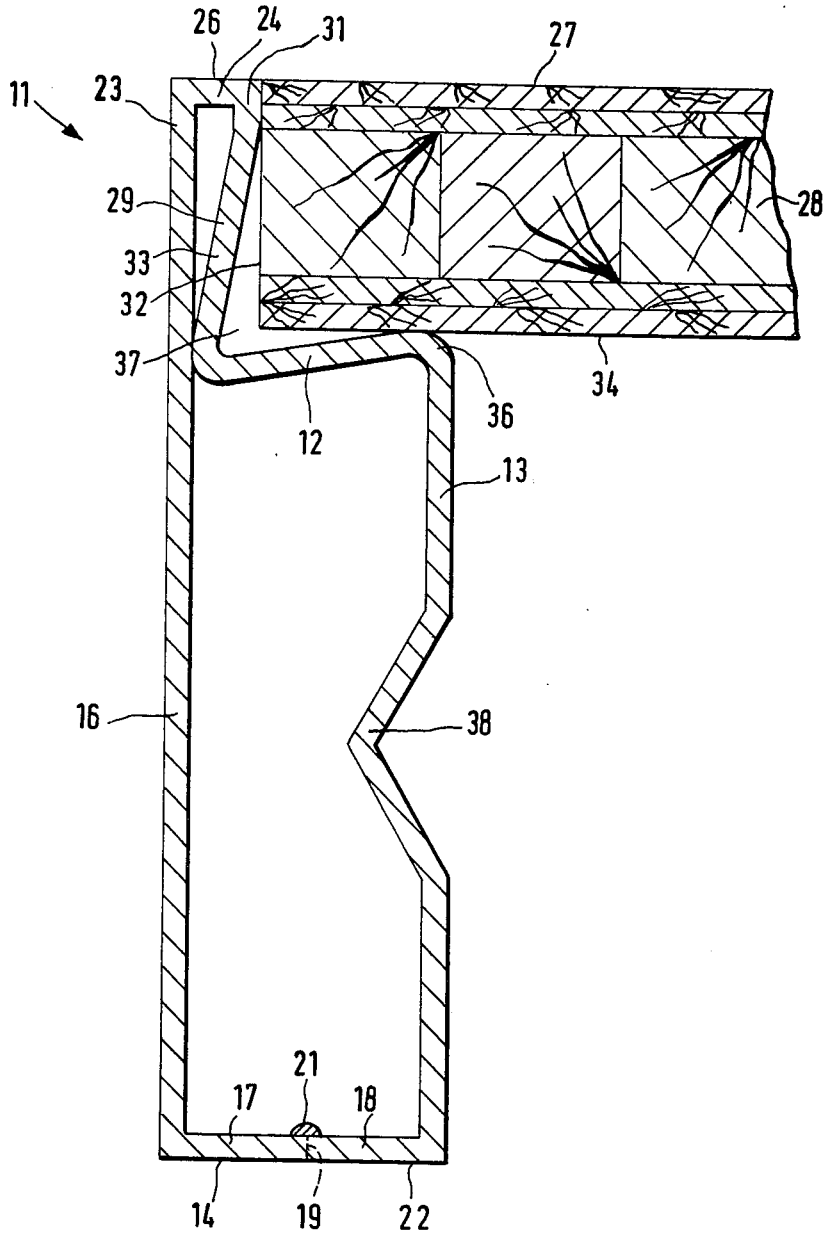
26
24
31
27
11
23
29
28
33
32
37
34
36
12
13
16
38
21
17
18
14
19
22

STEEL SECTIONS FOR FRAMEWORK PANELS

BACKGROUND OF THE INVENTION

The invention relates to a steel section for the framing and stiffening of formwork panels which serve for the shuttering of concrete masses, having a protuberance which rests on the outer circumferential surface of the formwork panel with a first, short flange which forms a continuation of the protuberance and rests on the marginal zone of the inner side of the formwork panel, with a second, long flange which forms a continuation of the first flange, stands perpendicular to the formwork panel and has a shallow, V-shaped indentation pointing towards the internal space of the steel section, with a third, short flange which forms a continuation of the second flange and extends outwards lying parallel to the formwork panel and with a fourth flange which forms a continuation of the third flange and extends in the direction towards the protuberance.

Such a section has become known from Austrian Pat. No. 322,186. In this case, a wooden bar is pushed laterally into the open cavity of the steel section to prevent concrete from flowing into it. This steel section has the following disadvantages:

1. It has appeared in practice that the wooden bar swells due to moisture. The wooden bar is also slowly frayed under stress in practical work. Two steel sections are always pressed against one another in use, but the desired flat pressing surface is lacking under these conditions.

2. It is very difficult to introduce the wooden bar into the steel section.

3. The wooden bar must have a quite specific cross-sectional form.

4. If the wooden bar is not held by the flanges, it must be held by additional screws which exert an initial stress upon the steel section, require passage holes and form obstacles.

5. In relation to its length, the fourth flange contributes little to the rigidity of the steel section.

6. If after a period of use, the wooden bar lacks a part of its volume, then the wedge of the bracing device must be driven in substantially more than was originally intended. Then the originally intended abutment conditions for the wedge surfaces change.

7. The corner zone between the protuberance and the first flange is right-angled. Correspondingly, the external circumferential surfaces of the formwork panel must also be trimmed to right angles. Otherwise, it is not possible to turn the formwork panel around and arrange the outer surface, which is worn after some time, inwards and the as yet unworn, originally inner surface now outwards.

8. On the finished concrete wall a burr is always distinguishable corresponding to the double thickness of the protuberance.

OBJECT AND STATEMENT OF THE INVENTION

It is the object of the invention to provide a steel section of the initially stated kind with which all the above-mentioned disadvantages are economically and durably avoided, without the need to rethink and redesign the already existing systems.

In accordance with the invention, this problem is solved by the following features:

(a) The third flange consists of two part-flanges which are butt-welded to one another at their end faces by a continuous seam.

(b) The part of the seam protruding beyond the outer surface of the third flange is removed by machining so as to be flush.

(c) The fourth flange continues to the protuberance.

(d) The protuberance comprises three walls of which the first forms the direct, straight continuation of the fourth flange, the second wall stands perpendicular to the first and is substantially shorter than it, extends parallel with the plane of the formwork panel and forms the continuation of the first wall, and the third wall is bent back to the first wall at an acute angle.

(e) The corner zone between the first flange and the third wall includes an angle smaller than 90°.

Burrs are further diminished by the features that the outer surface of the second wall is flat and merges with very small radii into the outer surfaces of the first wall and of the third wall.

The same applies to the feature that the third wall in its zone adjoining its outer radius extends approximately parallel with the first wall.

A high accuracy of dimensions is obtained economically by the features that the outer surface of the second wall has been machined by swarf removal.

Due to the features that the effective length of the protuberance is equal to the thickness of the formwork panel, one obtains optimum protection of the outer edges of the formwork panel, a higher inertia moment of the protuberance and thus higher rigidity and minimizes the visible impressions upon the concrete.

Other steel sections for the stiffening and framing of formwork panels have become known from French Pat. Nos. 484,403 1,334,430 and British Pat. Nos. 669,171, 783,774, 1,006,360 and 1,038,572.

BRIEF DESCRIPTION OF THE DRAWING

The invention will now be described with reference to the single FIGURE. It shows a cross-section through a steel section and the adjoining marginal zone of a formwork panel, on the scale 2:1.

DETAILED DESCRIPTION OF A PREFERRED EMBODIMENT

The steel section has a protuberance 11, a first flange 12, a second flange 13, a third flange 14 and a fourth flange 16. The third flange 14 consists of a part-flange 17 and a part-flange 18. Their end faces abut on one another and are connected with one another by an autogenous weld seam, exactly in the middle. Of this seam, only the bead 21 remains on the inside, while the outer bead, originally likewise present, has been removed by machining at red heat immediately after the welding, so that the outer surface 22 of the third flange 14 forms a plane.

The fourth flange 16 continues to the protuberance 11 and merges directly into its first wall 23. The first wall 23 is followed, with a bend to the right at right angles, by the second wall 24, which possesses a plane outer surface 16. The outer surface 26 is aligned with an outer surface 27 of a formwork panel 28. The outer surface 26 merges with a sharp edge with a radius hardly reproducible in drawing into the outer surface of the third wall 29. This is bent back with an angle of about 10° on the first wall 23. The third wall 29 in a zone 31 extends approximately parallel with the wall 23 and thus perpendicularly to the outer surface 27 and parallel to the edge 32 of the formwork panel 28. After the zone 31 there is provided a zone 33 which is also substantially straight.

The third wall 29 merges with an angle of about 70° into the first flange 12. On account of the forces occurring in rolling the first flange 12 is somewhat crooked, but this is of no importance since the inner surface 34 of the formwork panel 28 is seated only on the outer, upper knee zone 36 which is formed by the first flange 12 and the second flange 13. The vertical distance between the knee zone 36 and the outer surface 26 is equal to the thickness of the formwork panel 24. The edge 32 rests only against the outer surface of the very short zone 31. The resulting L-shaped wedge gap 37 permits working with relisable tolerances. In practice, it also permits easily turning the formwork panel 28 around so that its inner surface 34 becomes the outer surface.

Between the second wall 24 and the third wall 29 one could per se likewise provide a knee zone, which naturally would be bent substantially more than the knee zone 36. With the configuration as shown, however, success is obtained on the one hand in achieving sharply drawn section lines and on the other in not overextending the steel material, and one can make sensible demands of the roll sets of the bending machines which bend over the originally flat coil material.

The V-shaped shallow indentation 38 in the second flange 13 serves in the usual way for the engagement of clamping tools with which two adjacent steel sections are drawn against one another.

Since the weld seam was placed at the point illustrated it needs to withstand little in operation. As the part-flanges 17, 18 are of equal length a good welding result is also achieved. Since the weld seam is placed at the point illustrated the outer surface 22 can be made flat at favourable cost by utilizing the heating of the steel material which occurs due to the welding, and machining the surface while still at red heat. The outer surface 26 is so placed and so sized that it can also be made flat by a roller of the roll sets.

Regarding precise dimensions express reference is made to the scale drawing.

I claim:

1. In a steel section for the framing and stiffening of formwork panels which serve for the shuttering of concrete masses, comprising a protuberance which rests on the outer circumferential surface of the formwork panel, a first flange which forms a continuation of the protuberance and rests against a marginal zone of the inner side of the formwork panel, a second flange which is longer than the first flange, forms a continuation of the first flange, extends perpendicularly to the formwork panel and has a shallow, V-shaped indentation pointing towards the internal space of the steel section, a third flange which is shorter than the second flange, forms a continuation of the second flange and extends outwards lying parallel to the formwork panel, and a fourth flange which forms a continuation of the third flange, the improvement comprising the third flange consists of two part-flanges which are butt-welded to one another at their end faces by a continuous seam, the part of the seam protruding beyond the outer surface of the third flange is machine-flush, the fourth flange continues to the protuberance, the protuberance comprises three walls of which the first wall forms the direct, straight continuation of the fourth flange the second wall extends perpendicularly to the first wall and is substantially shorter than it, extends parallel with the plane of the formwork panel and forms the continuation of the first wall, the third wall is bent back to the first wall at an acute angle, and the corner zone between the first flange and the third wall includes an angle smaller than 90°.

2. A steel section according to claim 1, in which the outer surface of the second wall is flat and merges with very small radii into the outer surfaces of the first wall and the third wall.

3. A steel section according to claim 2, in which the third wall in its zone adjoining its outer radius extends approximately parallel with the first wall.

4. A steel section according to claim 2, in which the outer surface of the second wall has been machined by swarf removal.

5. A steel section according to claim 1, in which the effective length of the protuberance is equal to the thickness of the formwork panel.

* * * * *